United States Patent [19]

Morris

[11] 4,380,294

[45] Apr. 19, 1983

[54] APPARATUS FOR ASSORTING ARTICLES ACCORDING TO SIZE

[75] Inventor: Billy J. Morris, Visalia, Calif.

[73] Assignee: Industrial Manufacturers of Orosi, Orosi, Calif.

[21] Appl. No.: 231,661

[22] Filed: Feb. 5, 1981

[51] Int. Cl.[3] ..... B07B 13/05

[52] U.S. Cl. ..... 209/540; 209/617; 209/658; 209/663

[58] Field of Search ..... 209/617, 658, 663, 540

[56] References Cited

U.S. PATENT DOCUMENTS

| | | | |
|---|---|---|---|
| 1,140,782 | 5/1915 | Welton | 209/663 |
| 1,457,143 | 5/1923 | Brogden | 209/663 |
| 1,471,128 | 10/1923 | Holland | 209/663 X |
| 1,643,190 | 9/1927 | Von Canon | 209/663 X |
| 1,873,323 | 8/1932 | Evans | 209/663 |
| 2,258,460 | 10/1941 | Marsden et al. | 209/663 |
| 4,213,533 | 7/1980 | Sardo | 209/663 X |

*Primary Examiner*—Allen N. Knowles
*Attorney, Agent, or Firm*—Huebner & Worrel

[57] ABSTRACT

An apparatus for assorting articles, such as fruits, according to size, the apparatus having a conveyor which includes a pair of belts disposed in transversely upwardly divergent, V-shaped relation for transporting articles rested on the belts through a plurality of assorting stations having individual rotationally driven rollers disposed axially parallel to the direction of travel of the articles and mounted adjacent to the belts for adjustable movement toward and from the belts with the rollers of each station being spaced progressively closer to the belt in the direction of travel to engage articles of correspondingly smaller size and displace them transversely from the belts, the relative speeds of the belts in the direction of travel being independently controllable so that non-spherical articles being transported along the belts are rotatable to select the attitude in which such articles are presented to the rollers.

23 Claims, 12 Drawing Figures

APPARATUS FOR ASSORTING ARTICLES ACCORDING TO SIZE

BACKGROUND OF THE INVENTION

1. Field of the Invention

The present invention relates to an apparatus for assorting articles according to size, and more particularly to such an apparatus for use in sorting fruit and other agricultural produce accurately and rapidly into a plurality of sizes without damaging the articles.

2. Description of the Prior Art

In marketing agricultural produce, such as fruits, which grow in a relatively wide range of sizes, it is customary to assort the fruits by size into categories for marketing. The number of categories and the dimensional range in each category vary widely according to the type of fruit, the premium paid for larger sizes, marketing regulations, and the like.

Manual assorting of produce by size is both slow and highly inaccurate; therefore, machines for such assorting have long been well known. Prior art produce assorting machines typically utilize openings dimensioned sequentially as to size in a generally planar member over which the produce passes, articles smaller than the smallest dimension of each opening being assorted by falling through the opening. As produce to be assorted moves over the openings and the member, individual articles thereof are tumbled by contact with the member, and this tumbling damages the articles by contact with other articles and with the member. The assorting of produce by machines utilizing openings graduated in size through which articles fall is also deficient in that the resulting accuracy, although superior to hand sorting, leaves a great deal to be desired. Further, such assorting of articles which are not generally spherical results in relatively inaccurate sorting since the attitude at which each article arrives at an opening is unpredictable and, in any event, varies as the article tumbles along the planar member.

Another disadvantage of such prior art machines is that an opening of a given dimension can assort articles not larger than one size so that it is not possible to vary the range of sizes in each category even, as with substantially spherical articles of produce, it is possible for an opening to discriminate between articles of relatively limited differences in diameter.

A further disadvantage of many prior art machines for assorting produce is that a substantial amount of time is required to modify the machine for assorting fruits into categories of different sizes, since the members providing the sorting openings must be replaced or, at least, repositioned, and it is necessary to shut down the machine while the members are converted. Thus, most known assorting machines are limited to only one type or one kind of fruit each day because of the down time for conversion. It has long been considered highly desirable to provide an assorting machine which is convertible almost instantly to different types, sizes, shapes, and varieties of fruit.

PRIOR ART STATEMENT

In conformance with 37 C.F.R. §1.97 and §1.98, the applicant states that he is not aware of any prior art which is relevant to the patentability of the subject invention.

SUMMARY OF THE INVENTION

It is an object of the present invention to provide an improved apparatus for assorting articles according to size.

Another object is to provide such an apparatus which accurately assorts a stream of articles into a plurality of categories, each category including articles in a selected range of sizes.

Another object is to provide such an apparatus wherein the size of the articles in each category can be instantly varied through a relatively wide range.

Another object is to provide such an apparatus wherein such adjustment can be achieved conveniently and accurately in a relatively short time and while the apparatus is in operation.

Another object is to provide such an apparatus wherein such adjustment can be achieved without tools and by observation of an indicator showing the range of sizes to be assorted at each of a plurality of assorting stations, each station sorting out produce in a predetermined one of such categories.

Another object is to provide such an apparatus wherein the articles to be assorted are conveyed to and through an assorting station with minimal tumbling movement and with or without rotational movement.

Another object is to provide such an apparatus wherein articles which are not substantially spherical are positioned in a predetermined attitude for assortment by causing the articles to rotate as they are transported to the assorting stations, the speed of rotation being continuously adjustable over a range of speeds so that the articles are rotated only sufficiently to assume the predetermined attitude, thereby avoiding damage to delicate articles.

Still another object is to provide an apparatus for assorting articles according to size having elements easily and economically adapted to use in such an apparatus having a plurality of streams of articles to be sorted, each stream having a corresponding plurality of assorting stations and the corresponding stations being adjustable simultaneously so as to assort articles in substantially the identical range of size, thereby to increase the rate at which articles are assorted without sacrifice of any of the before stated objects and advantages.

A further object is to provide improved elements and arrangements thereof in an apparatus for assorting articles, such as fruit and other agricultural produce, according to size, the apparatus being economical, dependable, compact, durable, and fully effective in carrying out its intended purposes.

DESCRIPTION OF THE PREFERRED EMBODIMENT

Figure 1:
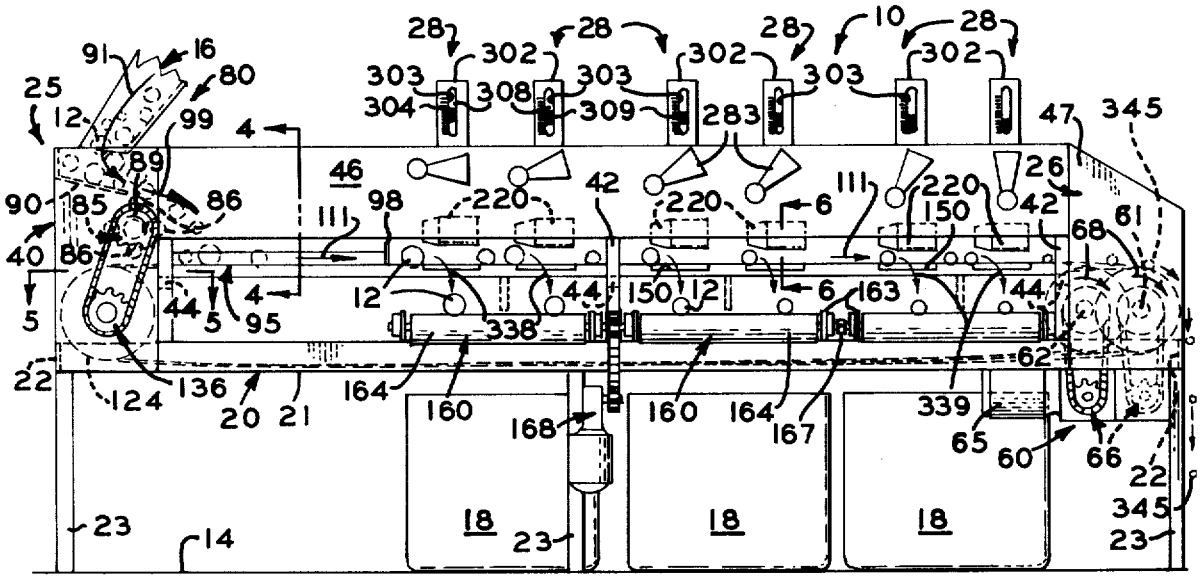
FIG. 1 is a side elevation of an apparatus for assorting articles according to size which embodies the principles of the present invention together with articles being assorted depicted in dash lines.
Figure 2:
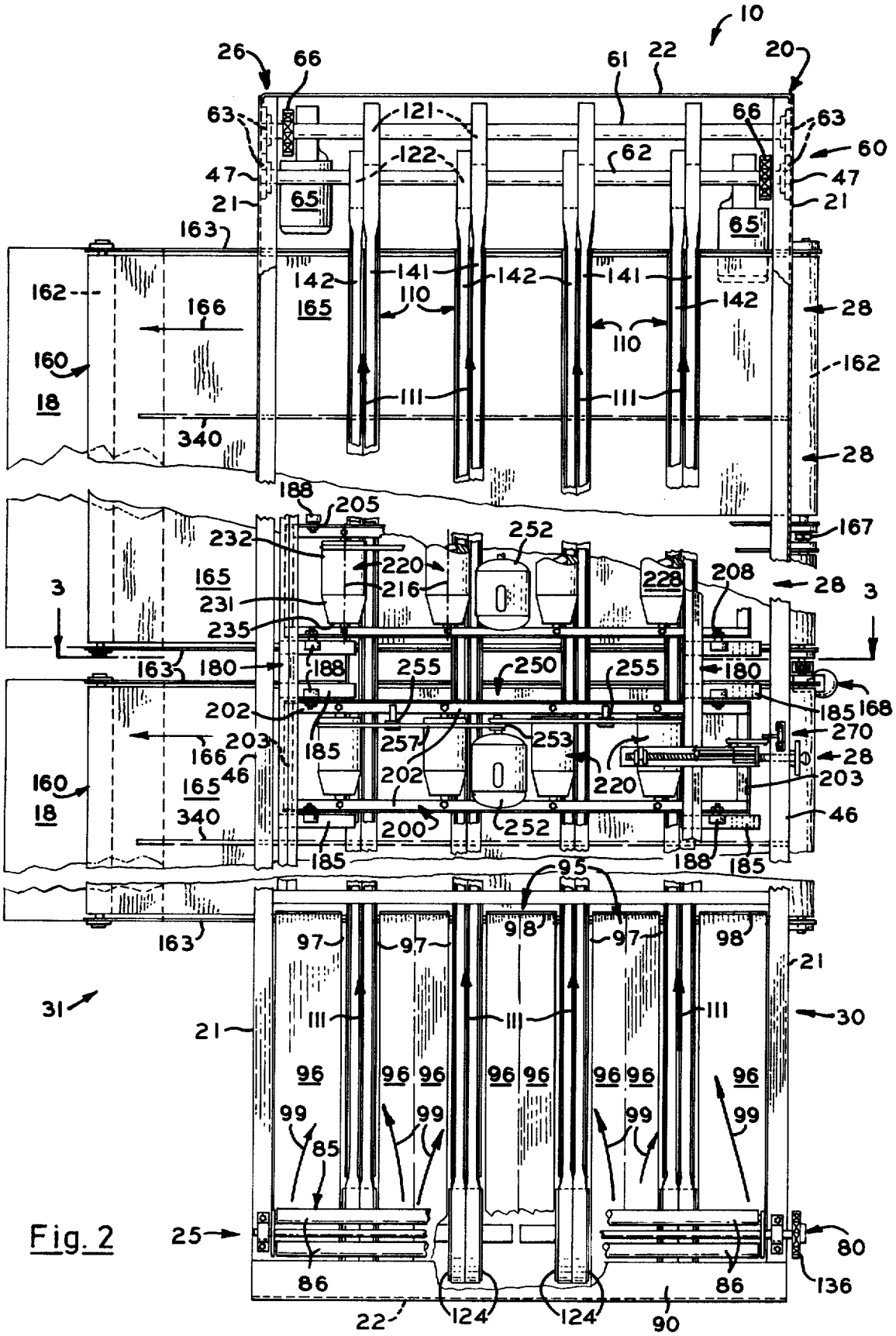
FIG. 2 is a plan view of the apparatus of FIG. 1 on an enlarged scale with portions broken away for illustrative convenience.

Referring with greater particularity to the drawings FIGS. 1 and 2 show an apparatus 10 embodying the principles of the present invention for assorting articles 12 according to size. The apparatus is depicted in a representative operating environment where it is supported on a floor 14. The apparatus is provided when the articles, typically fruit or other agricultural produce, from any suitable source thereof representated by a fragmentarily depicted chute 16. After assortment by the apparatus, the articles are received in any suitable manner, as by a plurality of containers 18 supported adjacent to the apparatus.

The apparatus 10 has a frame, indicated generally by the numeral 20. The frame is of elongated rectangular shape in plan view, having a pair of transversely spaced, horizontal, longitudinal beams 21 which are interconnected at their corresponding opposite ends by a pair of horizontal, transverse beams 22, both pairs of beams being supported upwardly of the floor 14 by legs 23. One longitudinal end portion of the frame is disposed beneath the chute 16 at a receiving station 25, the opposite end portion of the frame being at a cull rejecting station 26. The depicted apparatus has six substantially identical assorting stations 28 spaced longitudinally of the frame 20 and subsequently to be discussed in greater detail. As will be apparent to one skilled in the art, the apparatus may be provided with some other number of such stations. The assorting station closest to the receiving station, which is referred to as the first assorting station, is spaced substantially from the receiving station. The assorting station closest to the rejection station, which is referred to as the final assorting station, is adjacent to the rejection station. The apparatus has a control side 30, which corresponds to one of the longitudinal beams and is depicted as toward the left of FIG. 2 and the right of FIG. 3, and an opposite or discharge side 31 corresponding to the other of the longitudinal beams.

Figure 3:
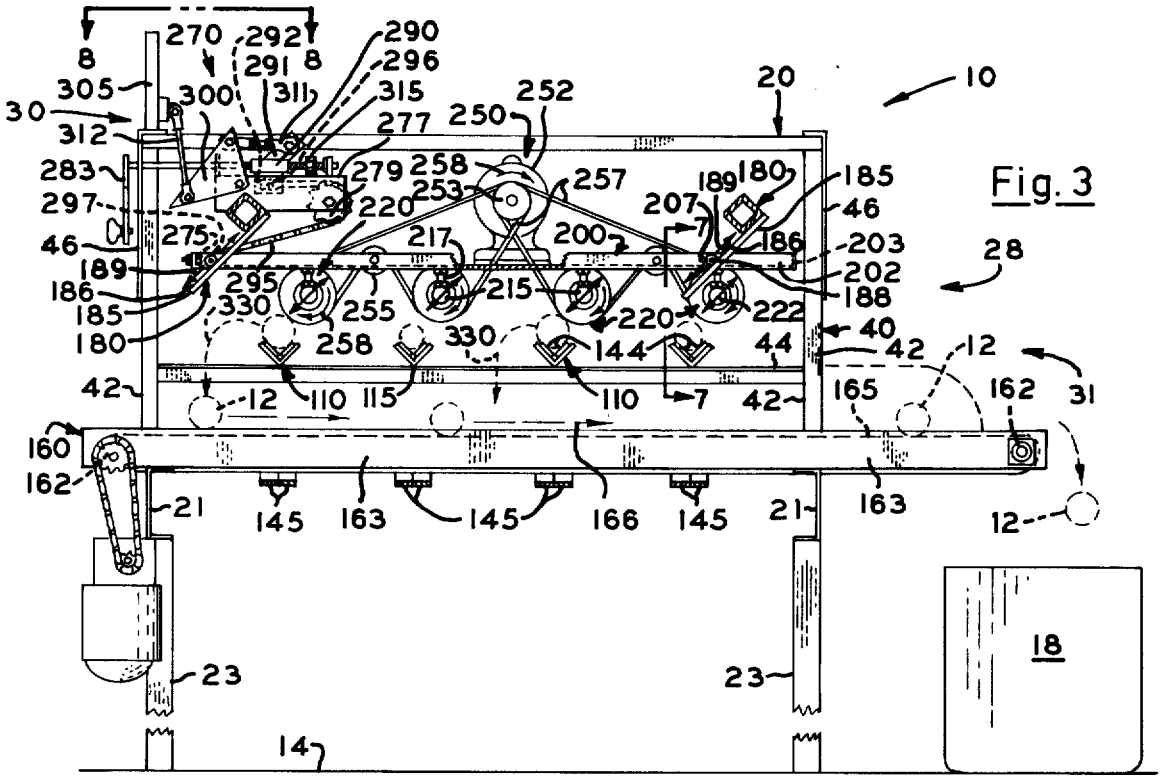
FIG. 3 is a vertical section of the apparatus together with the articles taken from the position of line 3—3 of FIG. 2.

The frame 20 includes a rectangular superstructure 40, best shown in FIGS. 1, 2, and 3, rigidly supported upwardly of the longitudinal beams 21 and the transverse beams 22 by a plurality of posts 42 spaced along and extending upwardly from each longitudinal beam. Each longitudinally corresponding pair of posts is interconnected by a transverse cross member 44 extended across the frame, one of the outwardly disposed pair of cross members being adjacent to the receiving station 25 and the other extending between the final one of the assorting stations 28 and the rejection station 26. The cross members are disposed substantially in a common horizontal plane. The superstructure has a pair of vertical, longitudinally elongated side plates 46 extending individually above the longitudinal beams from the end thereof at the receiving station to the rejection station. The lower edge of each plate is parallel to the longitudinal beam and is spaced upwardly of the cross members. A pair of trapezium-shaped plates 47 are individually aligned with the side plates and are disposed transversely oppositely of the rejection station.

The apparatus 10 has a power conveyor drive mechanism 60, shown in FIGS. 1 and 2, mounted on the frame 20 at the rejection station 26. This mechanism has a first drive shaft 61 and a second drive shaft 62. The shafts are parallel and horizontal and extend between the longitudinal beams 21, each shaft having opposite ends individually rotationally received in bearings 63 mounted on and upwardly of the longitudinal beams. The second shaft is spaced somewhat from the first shaft toward the receiving station 25. The drive mechanism includes a pair of electric rotational drive units 65 individual to the shafts and mounted on the frame 20 below the bearings. The unit corresponding to the first shaft is mounted toward the control side 30 and the unit corresponding to the second shaft is mounted toward the discharge side 31. Each unit is rotationally connected to its respective shafts by an individual chain and sprocket assembly 66 and is adapted to drive the corresponding shaft in a direction which is clockwise in FIG. 1 and is indicated by the arrows 68. The units are of well-known construction and are substantially identical for the purposes of the present invention. The units are adapted to drive the shafts at approximately the same speed; however, the rotational speeds are independently controllable over a continuous range in any suitable manner, as by controlled rectifiers individual to the motors of the unit, so that the rotational speed of the shafts selectively may be made substantially identical or varied or be made to differ.

Figure 4:
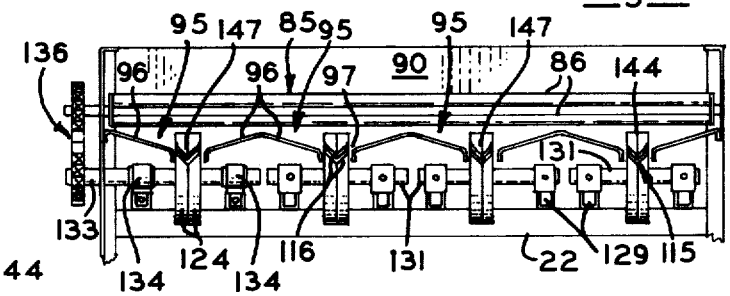
FIG. 4 is a fragmentary vertical section of the apparatus taken on line 4—4 of FIG. 1.
Figure 5:
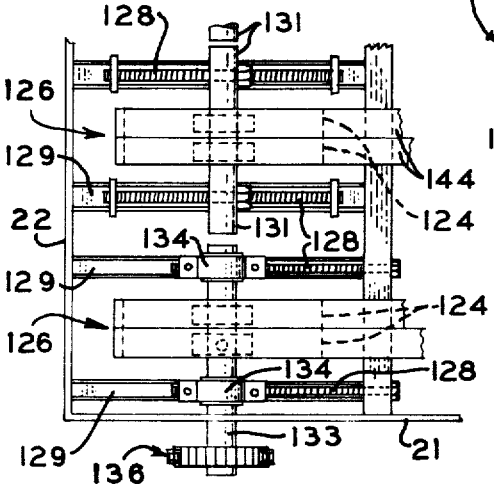
FIG. 5 is a fragmentary horizontal section of the apparatus taken from the position of line 5—5 of FIG. 1.

The apparatus 10 has a feeding assembly 80, best shown in FIGS. 1, 2, and 4, mounted on the frame 20 at the receiving station 25. This assembly is disposed generally between the side plates 46 and approximately at the elevation of their lower edges. The assembly includes a lobed rotor 85 extended between the side plates and mounted thereon for rotation about a horizontal axis extended transversely of the frame. The rotor has four lobes 86 formed by cylindrical tubes which extend parallel to the axis of the rotor and are spaced equally angularly thereabout. The spaces between the rollers are such that unsorted articles 12 are receivable between upwardly disposed adjacent pairs of the lobes for rotation therewith. The rotor is rotationally driven, in a manner subsequently to be described, so that the upwardly disposed pairs of the lobes move in a direction toward the rejecting station 26 as indicated by the arrows 89.

The feeding assembly 80 includes a planar feed plate 90 disposed oppositely of the rotor 85 from the rejection station 26 and between the side plates 46. The feed plate extends from beneath the chute 16 to an edge of this plate which is parallel and closely adjacent to the rotor. The feed plate is somewhat downwardly inclined toward the rotor so that, as indicated by the arrows 91, articles from the chute are gravitationally urged over this plate for reception between the lobes 86.

The feeding assembly 80 has four horizontal feed troughs 95 extending longitudinally of the frame 20 and oppositely of the feed plate from the rotor 85 to the first of the assorting stations 28. Transversely of the frame, the troughs are spaced between the side plates 46. Each trough is V-shaped and has a pair of opposite rectangular planar, parallel sides 96. The pair of sides are elongated longitudinally of the frame and are spaced apart transversely thereof so as to define a rectangular, longitudinally elongated slot 97 from which the sides extend oppositely and upwardly transversely of the frame. The troughs are substantially identical and the dimensions and proportions of the sides are such that the slots are substantially congruent and, transversely of the frame, are spaced substantially an equal distance from each other. The slots of all of the troughs lie in substantially the same horizontal plane and the upper edges of their sides are disposed somewhat below the axis of the rotor. The upward edges of the outermost pair of the sides engage the corresponding one of the side plates 46 and the adjacent upward edges of the other six sides are engaged so that, between the rotor and the first assorting station, the space between the side plates is downwardly closed except at the slots. The troughs are provided with upright barriers 98 which are adjacent to the first assorting station and are extended transversely between the slots. Due to the troughs and barriers, articles 12 received between the lobes 86 can only travel into the slots 97 as indicated by the arrows 99 in FIGS. 1 and 2.

The apparatus 10 has four substantially identical transporting conveyors, generally indicated by the numeral 110 and best shown in FIGS. 1 through 5. Any desired number can be provided. The conveyors transport articles 12 from the receiving station 25 through the assorting stations 28 along predetermined, elongated paths individual to the conveyors and indicated by the arrows 111. The conveyors are individually related to the slots 97 of the feed troughs 95. Each conveyor includes a rigid, elongated, transversely V-shaped, supporting trough 115 extended along the corresponding path 111 and aligned longitudinally of the frame 20 with the corresponding slot. The supporting troughs extend from the rotor 85 through the final one of the assorting stations 28 across and upwardly of the cross members 44 and are fixedly mounted on the cross members. Each trough has a pair of planar, rectangular, oppositely laterally inclined sides 116 transversely angularly related at an angle of approximately 90°, the lower edges of each side being engaged in parallel relation so that the trough is downwardly closed. The upper edge of each of these sides is substantially aligned vertically and closely adjacent the edges of the sides 96 of the feed troughs so that the articles entering each slot 97 are delivered to the corresponding conveyor. Since, as previously stated, the slots lie in the same horizontal plane and the cross members 44 are at the same elevation, the conveyors are horizontal and are disposed at substantially the same elevation in parallel, transversely side-by-side relation.

Each conveyor 110 has a first drive pulley 121, shown in FIGS. 1 and 2, mounted concentrically on the first drive shaft 61 for rotation therewith, and has a second drive pulley 122 similarly mounted on the second drive shaft 62. The pulleys are substantially identical and have cylindrical peripheries. The upper portion of each periphery is disposed somewhat below the support troughs 115. The axial width of the peripheries is substantially equal to the width in plan view of one of the sides 116 of the troughs so that the peripheries are narrower than these sides. In relation to the corresponding support trough and transversely of the frame 20, each first pulley is aligned with the one of these sides toward the conrol side 30, while each second pulley is aligned with the side of the trough toward the discharge side 31. The pair of pulleys corresponding to each conveyor are thus closely adjacent axially and are substantially spaced rom the pulleys of adjacent conveyors.

Each conveyor 110 includes a pair of coaxially related idler pulleys 124, best shown in FIGS. 1, 2, 4, and 5. Transversely of the frame 20, the pair of idler pulleys are individually substantially aligned with the corresponding pair of drive pulleys 121 and 122. The axis of the idler pulleys is substantially parallel to the drive shafts 61 and 62, and the upper portions of the idler pulley peripheries are disposed somewhat below the supporting troughs 115. Each pair of idler pulleys is mounted on the frame by a tensioning assembly 126, best shown in FIG. 5, on which the pair of pulleys rotate independently. Each tensioning assembly has a pair of screw-threaded rods 128 extended longitudinally of the frame 20 and disposed axially oppositely of the corresponding pair of idler pulleys and has a bracket 129 fixedly mounted on the frame and adapted rotationally to receive the rods while constraining them against axial movement. The tensioning assemblies are thus adapted to mount the idler pulleys for adjustable movement in a direction longitudinally of the frame 20 and along the corresponding paths 111. The three tensioning assemblies toward the discharge side 31 of the apparatus are substantially identical and each has a rotationally stationary shaft 131 on which the corresponding idler pulleys are rotationally mounted, the ends of the shaft being individually screw-threadably engaged by the corresponding screw-threaded rods. The tensioning assembly at the control side 30 includes a shaft 133 which is rotationally mounted on a pair of bearings 135 which are disposed outwardly of the corresponding idler pulleys and are individually engaged by the corresponding pair of screw-threaded rods. This shaft rotates with the one of the idler pulleys adjacent to the control side 30, while the idler pulley adjacent to this one pulley rotates on, but independently of, the shaft. The shaft extends outwardly of the adjacent one beam 20 and is there connected in rotational driving relation to the rotor 85 by a chain and sprocket assembly 136 of well-known construction.

Figure 8:
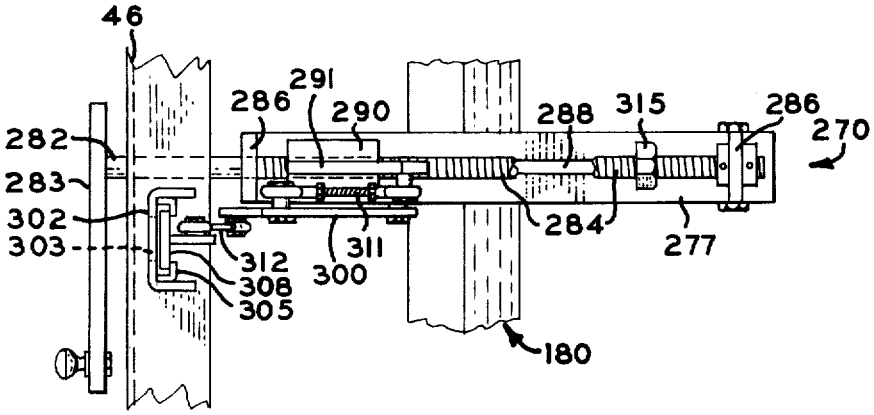
FIG. 8 is a fragmentary plan view taken from the position of line 8—8 of FIG. 3.

As best shown in FIGS. 1, 2, and 8, each conveyor 110 has a first endless belt 141, which is extended about its first drive pulley 121 and the idler pulley 124 aligned therewith, and a second endless belt extended about the second drive pulley 122 and the other idler pulley. The belts are flexible and substantially identical and, transversely, are substantially planar and equal in width to one of the pulleys. The belts are thus elongated and have individual upper runs 144 and lower runs 145. Each upper run extends between the upper portions of the peripheries of the corresponding pulleys above the corresponding side 116 of the associated supporting trough 115, while the lower run is disposed below the trough at approximately the elevation of the beams 21. Each belt is tensioned by moving the corresponding idler pulley away from the assorting stations 28 with the associated tensioning assembly 126 that the upper run of the belt is flatly, upwardly, and slidably engaged with the corresponding side of the trough. The angularly related sides of the trough are thus individually disposed in supporting relation beneath the upper runs and the upper runs are disposed in edgewardly adjacent relation to form an upwardly disposed trough 147 between them for transporting the articles 12 entering the corresponding slot 97. It is, therefore, apparent that each supporting trough maintains the corresponding upper runs in a predetermined, upwardly divergent angular relation and that this relation is determined by the angular relation of the sides of the trough. It is also apparent that the upper runs are substantially parallel in a direction along the corresponding path 111.

As before stated, the pulleys 121, 122, or 124, are narrower than the sides 116 and the width of the belts 141 and 142 is equal to the width of the pulleys so that the belts are narrower than the sides. As a result, since the pulleys of each conveyor are axially closely adjacent, the upper runs 144 of each conveyor 110 are closely adjacent at the bottom of the associated supporting trough 115 while the upper edges of the runs are spaced downwardly of the upper edge of the trough, except at the assorting stations 28 where each side of the trough is provided with a rectangular notch 150. The notch extends upwardly beyond the corresponding belt and is substantially longer in the direction of the path 111 than the greatest dimension of an article 12 to be assorted by the apparatus 10. Each notch has a horizontal lower edge 152, which is the upper edge of the corresponding side of the trough and which is disposed below the upper edge of the corresponding run. The runs thus extend upwardly of the upper edges of the trough at the assorting stations.

Tensioning each belt 141 or 142 as above described frictionally engages the belt with its drive pulley 121 or 122 so that the upper run 144 of the belt is motivated longitudinally in a direction along the corresponding path 111 at a linear speed corresponding to the rotational speed of the drive pulley. The relative linear speeds of the upper runs of each conveyor are thereby adjustable by controlling, in the manner before stated, the relative rotational speeds of the drive shafts 61 and 62. The upper runs can thus selectively be caused to move at substantially the same speed in a direction along the path or to move at different speeds in this direction.

The apparatus 10 has three substantially identical discharge conveyors 160 which are shown in FIGS. 1, 2, and 3 and are of conventional construction. Each conveyor is associated with an adjacent pair of the six assorting stations 28 and has a pair of substantially identical, axially elongated pulleys 162 extending horizontally in a direction longitudinally of the frame 20 oppositely outwardly of the notches 150 of the corresponding pair of assorting stations. One pulley of each pair is outwardly adjacent to the one of the longitudinal beams 21 at the control side 30 of the apparatus, while the other pulley is spaced substantially outwardly of the opposite longitudinal beam above a corresponding pair of the containers 18. The pulleys are rotationally mounted on the frame 20 by stretchers 163 disposed axially outwardly of and closely adjacent to the pulleys, each pulley having a pair of stub shafts extending axially oppositely from it through journals mounted on the adjacent stretchers. The pulleys are disposed below the troughs 147 formed by the upper runs 144 and are disposed upwardly of the longitudinal beams and the lower runs 145. Each discharge conveyor has a planar belt 164 looped about its pulleys to provide an upper run 165 of the belt which is continuously motivated, as indicated by the arrows 166, in a direction transversely of the frame from its control side toward its discharge side. The axial length of the pulleys is such that the stretchers of adjacent discharge conveyors are closely adjacent, and the width of each belt is substantially equal to the length of the pulleys. The axes of the three pulleys adjacent to the control side of the apparatus are substantially aligned and their adjacent stub shafts are rotationally interconnected by flexible rotational drive couplings 167. The discharge conveyors are motivated by an electrical power drive mechanism 168, which is of well-known construction and is mounted on the frame 20 at the control side between the pair of discharge conveyors toward the receiving station 25. This mechanism includes chain and sprocket elements rotationally driving the one of the flexible couplings which is disposed between this pair of conveyors.

Figure 7:
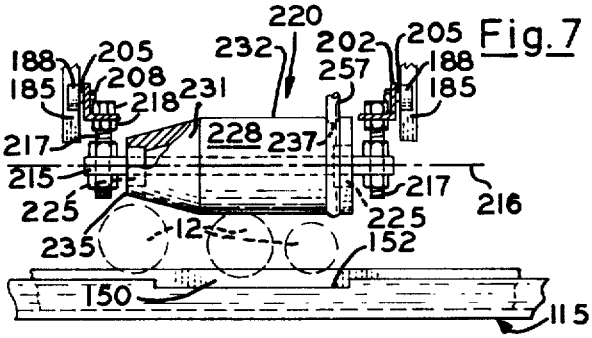
FIG. 7 is a fragmentary vertical section at an enlarged scale taken from the position of line 7—7 of FIG. 3 together with generally spherical articles represented in dash lines.

As shown in FIGS. 2, 3, and 7, each assorting station 28 has a mounting framework 180 of rectangular parallelepiped configuration fixedly mounted on and upwardly of the beams 21. Each framework is provided with four substantially identical ramps 185 disposed between the side plates 46 in a rectangular configuration. Transversely of the frame 20, a pair of the ramps is disposed adjacent to each side plate, while, longitudinally of the frame, a pair of the ramps is spaced somewhat outwardly in each direction from the corresponding notches 150 in the sides 116 of the troughs 115. The ramps of each latter pair are aligned transversely of the frame and are spaced transversely oppositely of the upper runs 144 and of the conveyors 110. The ramps are fixedly mounted in relation to the frame and are bars having individual continuous and planar upper surfaces 186. These surfaces are disposed at substantially the same elevation and are parallel to each other and, as best shown in FIG. 3, are parallel to the sides 116 which are disposed toward the discharge side 31 of the apparatus. The upper surfaces are, therefore, substantially parallel to the upper runs of the second belts 142 and to the path 111 along which articles move on the conveyors and are laterally inclined from the conveyors with the angle between the ramps and the horizontal being substantially equal to the angle between the upper runs and the horizontal.

Each ramp 185 is provided with a roller ramp follower 188 which has a rotational axis substantially parallel to the path 111. Each follower is rested peripherally on the upper surface 186 of the corresponding ramp for guided movement in a path indicated by the arrows 189. This path extends along the ramp and is elevationally and transversely related to the upper runs 144. It is apparent that the paths of the followers are in a direction parallel to the upper runs of the second belts and are in a direction which is substantially normal to the upper runs of the first belts and is toward and from these runs.

Each assorting station 28 has a rigid horizontal frame or subframe 200, best shown in FIGS. 2 and 3, which is of rectangular configuration and is disposed between and at the same elevation as the ramps 185. The subframe has a pair of opposite mounting bars 202 extending in a direction transversely of the frame 20 and spaced so that each pair of ramps aligned in this direction are disposed in closely adjacent relation to and outwardly of the mounting bar. The subframe has a pair of opposite spacer bars 203 which extend longitudinally of the frame between the mounting bars. The length of the mounting bars is somewhat greater than the distance across the troughs 115 so that the subframe extends across the upper runs 144 in bridging relation thereto. Each mounting bar has a pair of pivots 205 which are spaced along the bar a distance substantially equal to the distance therealong between the corresponding points on the adjacent pair of the ramps. The pivots individually mount the roller followers 188 for rotation about their respective axes, the axes of the followers of each ramp being substantially at the same elevation. Each of the pivots adjacent to the control side 30 is slidably received in a horizontally elongated slot 207 in the corresponding mounting bar and includes a clamp nut 208. This nut serves to secure the corresponding follower in fixed relation to the bar after adjusting the follower along the slot to a position such that the axis of the follower is substantially at the elevation of the axis of the other follower mounted on the same mounting bar.

It is apparent that the followers 188 of each assorting station support its subframe 200, together with elements mounted thereon and subsequently to be described, on the ramps 185 so that the subframe is mounted on the followers for movement therewith and moves therewith in a path elevationally and transversely of the upper runs 144 which corresponds to the paths 189 in which the followers are guided by the ramps. Since all of the surfaces 186 of the ramps are substantially parallel, the six subframes move transversely and elevationally in parallelism in relation to each other and to themselves during such movement.

As best shown in FIGS. 2, 3, and 7, each subframe 200 has four horizontal shafts 215 fixedly mounted thereon and downwardly thereof. The shafts extend longitudinally of the frame 20, and each shaft has a pair of opposite ends disposed individually beneath the mounting bars 202 of the subframe. The shafts individually define four substantially parallel and horizontal rotational axes 216. Each end of each shaft includes an upright screw-threaded standard 217 extended upwardly from the axis through a bore, not shown, in the corresponding mounting bar. The standard has a pair of clamp nuts 218 screw-threadably engaged therewith oppositely of this mounting bar. The standard and nuts adapt the shaft for adjustment vertically in relation to the subframe. The axes 216 are substantially parallel to the paths 111 along the conveyors 110 and are spaced transversely a distance substantially equal to the distance therebetween with each axis being disposed in upwardly spaced, adjacent relation to the upper run 144 of the second belt 142 of a corresponding one of the conveyors. Each axis thus lies in a plane which is parallel to the path of the corresponding conveyor and which intersects this conveyor.

Each subframe 200 has four article removing rollers 220 individually rotationally mounted on each shaft 215 for rotation about the corresponding axis 216. Each conveyor thus has six of the rollers associated with it, the six rollers are individual to the assorting stations 28 and are mounted thereat by the corresponding framework 180, ramps 185, followers 188, subframe 200, and bearings 215, the subframe of each assorting station being individual to the four rollers thereat and mounting the corresponding rollers in the assorting station. It is apparent that, as the subframe moves transversely of the frame 20, the followers 188 are guided by the ramps 185 so that the subframe, together with the rollers which are carried thereby and their axes 216, are constrained to move in a path conforming to the paths 189. This path is, as shown in FIGS. 3 and 8, toward and from the upper run 144 of the first belt 141 and parallel to the upper run of the second belt 142, the roller and axis moving in a path indicated by the arrows 222. Since the surfaces 186 are continuous, there is a continuous range of positions along the path for the axis.

The rollers 220 are substantially identical and are axially elongated, the construction of each individual roller being best shown in FIG. 7. Each roller has a pair of bearings 225 individual to its axial ends by which the roller is mounted on the corresponding shaft 215 for rotation about the axis 216 thereof. The peripheral portion of the roller is unitarily constructed of resilient but relatively stiff rubber-like material and provides a peripheral surface 228 which is concentric with the axis 216 of the roller. The peripheral surface extends axially between the corresponding mounting bars 202 in alignment transversely of the frame 20 with the notches 150 at the corresponding assorting station 28. The periphery of the roller has a frusto-conical axial end portion 231 disposed toward the receiving station 25, the balance of the periphery being an opposite cylindrical axial end portion 232 thereof. These portions are coaxially related and their axes coincide with the axis of the roller so that the peripheral surface is formed by surfaces of revolution concentric with this axis. The larger diameter end of the frusto-conical portion is equal to the diameter of the cylindrical portion and the frusto-conical portion extends from the cylindrical portion to a smaller diameter end 235 spaced therefrom toward the receiving station 25. As shown in FIG. 3, the radius of the cylindrical portion is approximately equal to the width of the upper runs 144 and the radius of the smaller diameter end is approximately one-half of this width. It is apparent that the peripheral surface of the roller is more closely spaced to the corresponding conveyor 110 at the cylindrical portion than at the smaller diameter end of the frusto-conical portion. As shown in FIGS. 2 and 7, each roller is provided with an annular driving groove 237 about its cylindrical end portion, the groove being disposed thereon oppositely of the frusto-conical portion. These grooves of the four rollers of each subframe 200 are in general alignment axially of the rollers, but the grooves of the pair of rollers toward the discharge side 31 are spaced somewhat toward their frusto-conical portions from the grooves of the pair of rollers toward the control side 30.

The disposition of the shafts 215 on the subframe 200 and the proportions and dimensions of the rollers 220 are such that each of their peripheral surfaces 228 is disposed in a predetermined adjacent spaced relation to the corresponding upper run 144, one side of the roller being disposed toward the corresponding upper run as the roller rotates about its axis 216. This relation is substantially identical for the four rollers mounted on each subframe. Although the spacing of the peripheral surfaces of the four rollers from the corresponding upper runs varies as the subframe moves transversely of the runs while being guided by the ramps 185, at every position of the subframe along the ramps the dispositions of the peripheral surfaces of the four rollers are substantially identical in relation to the corresponding upper runs.

Each axis 216 and the roller 220 rotating thereabout are disposed in relation to the corresponding upper runs 144 so that the path 222 of the axis, which is parallel to the upper run of the second belt 142 is spaced from this run a distance substantially equal to the radius of the cylindrical portion 232 of the peripheral surface 228. When the axis is at the uppermost position of its path, as indicated by the numeral 240 in FIG. 8, the side of the cylindrical portion toward the upper run of the first belt 141 is spaced from this run a distance approximately equal to the diameter of the cylindrical portion. However, when the axis is at its lowermost position along the path, as indicated by the numeral 242, this side of the cylindrical portion is closely adjacent to the upper run of the first belt. There is, of course, a continuous range of positions of the axis between its uppermost and lowermost positions and there is a corresponding range of positions of the roller in relation to the upper runs. Since the surfaces 186 of the ramps 185 are substantially parallel to the paths 111 along the conveyors 110, the axes of the rollers remain in substantial parallelism to this path as the axes move along their respective paths 222.

Each subframe 200 is provided with a roller drive mechanism 250, best shown in FIGS. 2 and 3, mounted on the subframe for movement therewith along the corresponding ramps 185. The mechanism includes an electric motor 252 which is energized in any suitable manner and has a shaft which is parallel to the axes 216 of the four corresponding rollers 220. The shaft bears a driving pulley 253 which rotates with it and bears a pair of annular grooves. One groove is axially aligned with the grooves 237 of the pair of rollers toward the side 30 and the other groove is aligned with the grooves of the pair of rollers toward the side 31. The mounting bar 202 adjacent to these grooves has a pair of idler pulleys 255 rotationally mounted on it in individual alignment with the grooves of the driving pulley. One of the idler pulleys is disposed between each of the above-mentioned pairs of the rollers. The mechanism includes a pair of endless bands 257. One band is looped about each groove of the driving pulley and is looped about the idler pulley and the grooves of the rollers which are aligned with this groove of the driving pulley. As indicated by the arrows 258, the motor is adapted to rotate in a predetermined direction and, by frictional engagement with the bands, to drive the rollers in the same direction. This direction is such that the side of the peripheral surfaces 228 disposed toward the upper runs 144 travels transversely thereof in a direction which is from the upper run of the second belt 142 toward the upper run of the first belt 141.

Each assorting station 28 is provided with an adjusting and indicating mechanism, indicated generally by the numeral 270 and best shown in FIGS. 1, 3, and 8. This mechanism moves the corresponding subframe 200 transversely in relation to the upper runs 144 of the conveyors 110 adjustably to position the subframe in relation thereto and move the followers 188 along the paths 189 determined by the ramps 185. The mechanism thus serves to position the axes 215 along their respective paths 216 to select a predetermined spacing between the side of the peripheral surface 228 of each roller 220 and the adjacent pair of upper runs. The mechanism also serves to indicate such spacing.

Each mechanism 270 is disposed toward the control side 30 and is disposed centrally of the mounting bars 202 of the corresponding subframe 200. The mechanism has a connector 275 disposed centrally of the spacer 203 which is toward the control side of the mechanism, and has a bracket 277 fixedly mounted on the corresponding framework 180. The bracket extends parallel to the mounting bars and above and beyond the connector to an end of the bracket disposed centrally of the subframe. The mechanism has an idler sprocket 279 mounted on this end for rotation about an axis generally parallel to the axes 216. The bracket also rotationally mounts a horizontal shaft 282 which extends above the bracket transversely of the frame 20 and outwardly thereof through a suitable opening, not shown, in the one of the side plates 46 at the control side 30 and terminates in a crank handle 283 disposed outwardly of this side plate. The portion of the shaft above the bracket is provided with external screw threads 284, and the opposite ends of this portion are provided with individual bearings 286 which are fixed to the bracket and rotationally mount the shaft while constraining it against axial movement. The bracket has an elongated slot 288 extended axially beneath the shaft.

The mechanism 270 has a traveling nut 290 which is received on and screw-threadably engaged with the screw threads 284 of the shaft 282. The nut is of unitary construction and has an upwardly extended arm 291 and has a downwardly extended arm 292 which projects through the slot 288 to a point disposed at substantially the same elevation as the upper portion of the periphery of the sprocket 279. The slot thus restrains the traveling nut against rotation with the shaft while permitting the nut to travel axially therealong. The mechanism has a chain 295 having one end 296, which is fixedly connected to the downwardly extended arm at a point below the slot, and having an opposite end 297 which is secured to the subframe 200 by the connector 275. Between its ends, the chain is return-looped about the sprocket, as best shown in FIG. 3. It is apparent that rotation of the crank handle 283 in a direction such that the traveling nut moves toward the control side 30 tensions the chain and draws the subframe 200 and the elements mounted thereon upwardly along the corresponding ramps 185 so that the peripheral surfaces 228 of the rollers 220 mounted on the subframe move elevationally and transversely away from the upper runs 144 of the first belts 141. Conversely, rotation of the crank handle in the opposite direction permits the subframe and such elements to descend the ramps gravitationally so that the peripheral surfaces move toward these upper runs. Rotation of the crank handle thus spaces the rollers varying distances from the upper runs so as to accommodate articles 12 of different sizes between each roller and its respective run.

Each mechanism 270 includes a bell crank 300 mounted on the bracket 277 for pivotal movement about an axis parallel to the axes 216. The bell crank has an upper, generally horizontally moving end, which is aligned elevationally and transversely of the frame 20 with the upwardly extended arm 291, and has a generally vertically moving end which is inwardly adjacent to the side plate 46 at the control side 30. This side plate has six scales 302 individually corresponding to the bell cranks and to the handles 283. The scales are erect channel-like members fixedly mounted on the side plate and extended upwardly therefrom above the vertically moving end of the bell crank. Each scale has a vertical slot 303 therein and bears indicia 304 which are adjacent to the slot and are disposed toward the control side for viewing by a person grasping the corresponding crank handle. The scale has guides 305 which are disposed oppositely thereof from the indicia and define a pair of vertical grooves disposed oppositely of and parallel to the slot. Each scale is provided with an indicator 308 which slides vertically in the guides and is visible through the slot. The indicator bears an indicia area 309 which contrasts, as in color, to the balance of the indicator which is visible through the slot. Each mechanism has a pair of links 311 and 312 which, respectively, connect the horizontally moving end of the bell crank to the arm 291 of the traveling nut 290 and connect the vertically moving end of the bell crank to the indicator. The indicator thus moves upwardly and downwardly in relation to the scale as the axes 216 of the corresponding subframe 200 move correspondingly from and toward the upper runs 144 of the first belts 141. The proportions and dimensions of the links, bell crank, scale, indicator, and the calibration of the indicia 304 are such that the contrasting area 309 indicates, by reference to the indicia, the relative spacing from such upper run of the smaller diameter end 235 and of the smaller diameter end 235 and of the cylindrical portion 232.

Each mechanism 270 includes a stop nut 315 screw-threadably engaged with the screw threads 284 of the shaft 282. This nut is engaged with the portion of these screw threads toward which the traveling nut 290 moves as the corresponding subframe 200 moves downwardly along the associated ramps 185. The stop nut is adjustably positionable along the shaft by rotation relative thereto so as to engage the traveling nut and prevent further movement thereof when the rollers 220 attain their lowermost position 242.

OPERATION

The operation of the described embodiment of the subject invention is believed to be clearly apparent and is briefly described at this point. Before the apparatus 10 is supplied with articles 12 to be assorted, the subframes 200 are adjusted by their respective mechanisms 270 so that articles in a different range of sizes are sorted from the conveyors 110 at each assorting station 28. The subframes are adjusted, by rotation of the corresponding crank handles 283 so that, in the direction 111 along each conveyor 110, successive rollers 220 and their peripheral surfaces 228 are spaced in successive increments progressively more closely to the conveyor. The desired such spacing is determined by observation of the relative positions of the indicators 308 in relation to the indicia 304 of their respective scales 302. The peripheral surfaces are thus spaced progressively more closely toward the upper run 144 of the first belt 141 in the direction of movement of the first belt and of the second belt 142. Since the four rollers at each assorting station have a substantially identical disposition in relation to the four conveyors, the four rollers at each station have substantially the same spacing from the corresponding upper runs.

When the desired positions of the rollers 220 in relation to the conveyors 110 are obtained at each assorting station 28, the drive units 65 are energized, causing the upper runs 144 of the belts 141 and 142 to move in the direction 111 and causing the rotor 85 to rotate in the direction 89. Articles 12 to be assorted are then supplied from the chute 16 and, as shown in FIGS. 1 and 3 and indicated by the arrows 91 and 99, are fed by the rotor and the troughs 95 individually onto the upper runs, each article being rested on and between a pair of the upper runs for transportation thereby in such direction from the receiving station 25 to the assorting stations 28.

Figure 6:
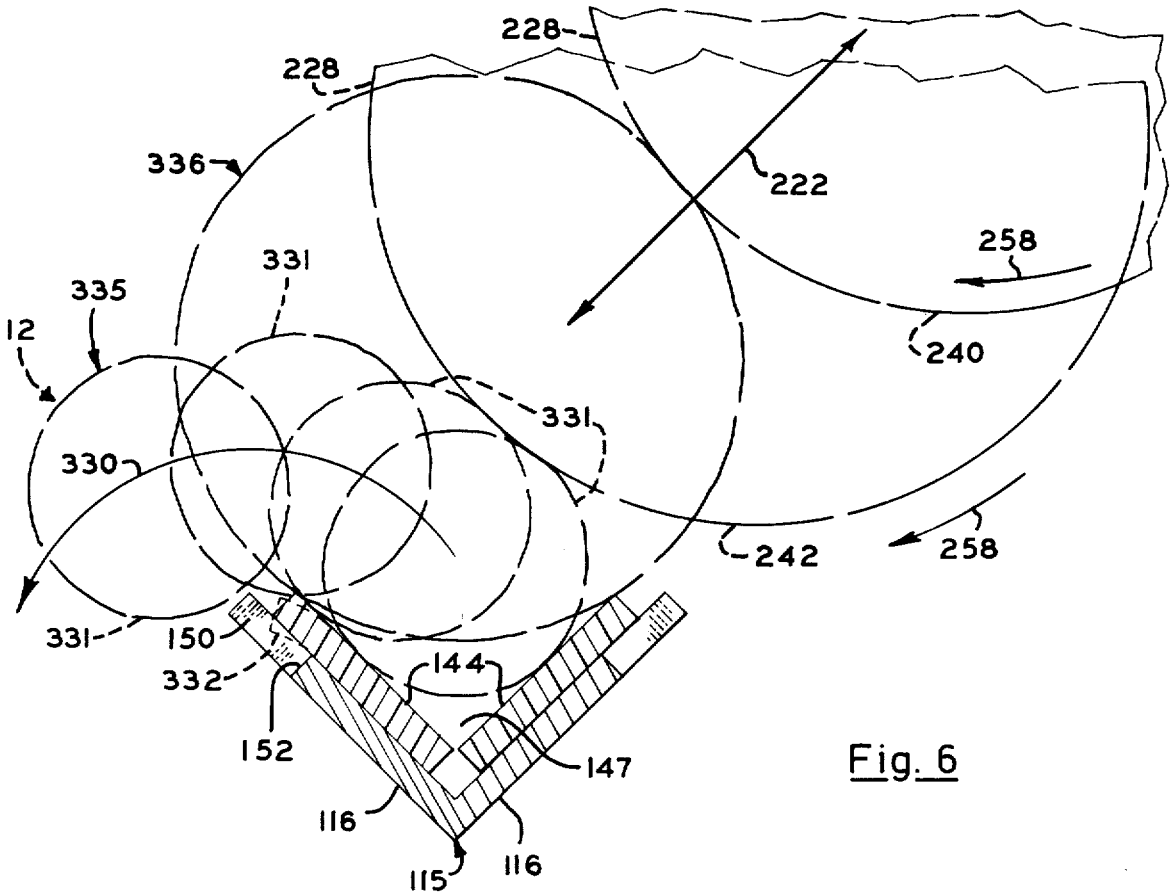
FIG. 6 is a vertical section of the apparatus at an enlarged scale taken from the position of line 6—6 of FIG. 1 with alternate positions of a roller and of an article being assorted represented, respectively, by dash lines of graduated length.

For simplicity in explanation, it is assumed at this point that, as when oranges are being assorted, the articles 12 are generally spherical and that the drive units 65 are controlled so that the upper runs 144 move substantially at the same speed. Each article is thus transported on the upper runs of a corresponding conveyor 110 substantially without rotation relative thereto. Under the assumed conditions, each article 12 is transported, as best shown in FIGS. 1, 3, 6, and 7, by the conveyor to an assorting station 28 at which the peripheral surface 228 of the corresponding roller 220 is spaced from the upper run of the first belt 141 a distance less than the diameter of the article. At such station, the article is engaged by such surface and is displaced thereby from the conveyor in a path, indicated by the arrows 330 in FIGS. 3 and 6 through successive positions, indicated in FIG. 6 by the numeral 331, onto the corresponding discharge conveyor 160. The discharge conveyor carries the displaced article in the direction 165 and deposits it into the corresponding one of the containers 18. As an article is displaced at an assorting station, the article passes through the corresponding notch 150 and, as shown in FIG. 6, engages the upper portion of the corresponding first belt 141. The article causes this portion to flex, as indicated by the numeral 332, over the edge 152 of the notch so that the article does not contact the rigid trough 115 and is not damaged thereby.

It is apparent that the peripheral surface 228 of each roller 220 will displace from the corresponding conveyor 110 those articles 12 which extend from the upper run 144 of the first belt 141 toward the axis 216 of the roller a distance greater than the distance between this peripheral surface and such upper run. When the axis is moved toward such run, as when the roller is moved toward its lowermost position 242, an article, which extends a relatively lesser such distance and is indicated by the numeral 335, will be displaced. However, when the axis is moved away from such run, as when the roller is moved toward its uppermost position 240, an article, which extends a relatively greater such distance and is indicated by the numeral 336, will be displaced. Each mechanism 270, together with the associated ramps 185 and followers 188, thus positions the subframe 200 and rollers selectively to vary the sizes of articles engaged by the corresponding peripheral surfaces and to determine the sizes of articles displaced from the conveyors at the corresponding assorting station 28. These sizes are substantially the same for the articles displaced from each conveyor by the four rollers at each station since the rollers have substantially identical dispositions in relation to the conveyors. It is apparent that each assorting station is adjustable to assort from the conveyors articles larger than a predetermined size in a continuous range of sizes. Such predetermined size corresponds to the distance the cylindrical portions 232 are spaced from the upper runs, and the continuous range corresponds to such distance plus the difference in radii of the cylindrical portions and the smaller diameter ends 235. It is apparent from FIGS. 6 and 7 that each roller will displace articles moving toward it along the corresponding path 111 in such a range in which the largest and smallest articles are characterized by having diameters which differ by the difference in the diameters of the end 235 and the cylindrical portion of the roller.

Since the rollers 220 at each station 28 are spaced progressively closer to the runs 144 in a direction along the path 111, articles 12 of correspondingly and progressively smaller sizes are engaged by the rollers and displaced from the conveyors 110 and received by the containers 18 as the articles move along the path, those articles too small for removal at any one station being subject to removal at any other station disposed therefrom in a direction along the path. In FIG. 1, the removal of articles of larger size is indicated by the numeral 338 and the removal of articles of smaller size by the numeral 339. The rollers at each station are adjusted with the corresponding mechanisms 270 so that the smaller diameter ends 235 are spaced no closer to the conveyors than are the cylindrical portions 232 of the rollers at the preceding station so that articles in the predetermined range of sizes accommodated by each roller will be received on its frusto-conical portion 231. If this range is insufficient to accommodate a marketable cateogory of sizes, a plurality of the assorting stations may be adjusted so as to span together each marketable range. In this event, contents of the corresponding containers are combined or else a single container elongated along the path 111 is utilized. If the desired categories can be accommodated with fewer than all of the assorting stations, the rollers of the superfluous stations are spaced sufficiently from the conveyors so as not to engage the articles, the superfluous stations being disposed in any order along the conveyor. If articles in two different ranges of size assorted at a pair of assorting stations having the same discharge conveyor and the articles in each range are to be kept separated, a partition is disposed centrally along this discharge conveyor, as indicated by the dash line 340 in FIG. 2, to ensure that articles in each range are kept separated as they are transported along the corresponding conveyor only to a corresponding one of the containers. In this event, a pair of containers spaced along the path 111 are utilized with each conveyor, rather than one as shown in the drawings. Those articles too small to be engaged by any of the rollers remain on the upper runs 144 and are transported thereby to the cull rejection station 26 where such articles are rejected from the apparatus 10 as indicated by the arrow 345 in FIG. 1.

It is apparent that the spacing between the rollers 220 and the conveyors 110 at each assorting station 28 can be conveniently and speedily adjusted with the mechanisms 270 simply by rotation of the handles 284 without any disassembly of the apparatus 10. As a result, if it is desired to assort articles of a different average size, as tangerines instead of oranges, or to assort articles of the same average size into different ranges of sizes, such adjustment is easily achieved even without deenergizing either the drive unit 65 or the motors 252. As a result, the apparatus is adjustable while articles to be assorted are being carried by the conveyors and are being assorted at the stations, such adjustment being advantageous to correct an incorrect initial adjustment or to differentiate properly between articles of nearly the same size which are to be assorted into different containers 16.

Figure 9A:
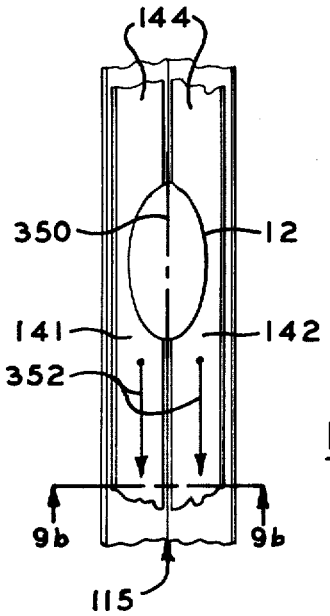
FIG. 9*a* is a fragmentary top plan view showing a prolate article being transported on a pair of conveyor runs utilized in the apparatus with the runs moving at the same speed.
Figure 9B:
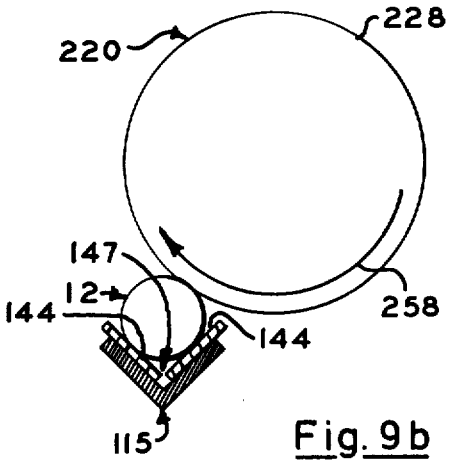
FIG. 9*b* is a vertical section taken from the position of line 9*b*—9*b* in FIG. 9*a* with the prolate article depicted as being engaged by a roller surface.

Referring now to FIGS. 9*a* and 9*b*, it is seen that the apparatus 10 is adapted to assort articles 12, such as lemons, which are prolate, being elongated along an axis indicated by the numeral 350. In assorting such articles, the driving units 65 are adjusted, as with spherical articles, so that the speeds of the belts 141 and 142 are the same as indicated by the equal length vectors 352 in FIG. 9*a*. As a result, prolate articles do not rotate relative to the upper runs 144. As such articles pass from the receiving station 25 to the first of the assorting stations 28, each article gravitationally assumes a position in which its elongated axis is parallel to the direction 111. As a result, the articles are assorted by size corresponding to their diameters about such axis as best shown in FIG. 9*b*.

Figure 9C:
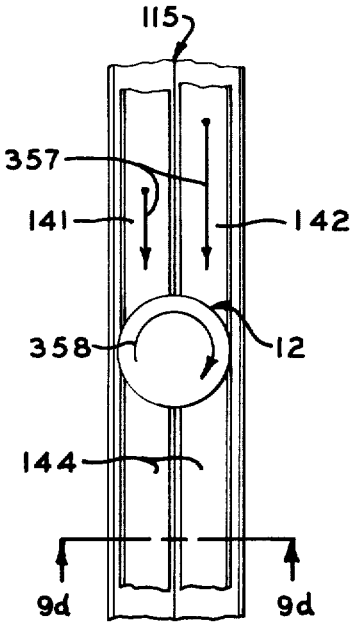
FIG. 9*c* is a fragmentary top plan view depicting the runs of FIG. 9*a* moving in the same direction at different speeds and transporting and rotationally driving an oblate article.
Figure 9D:
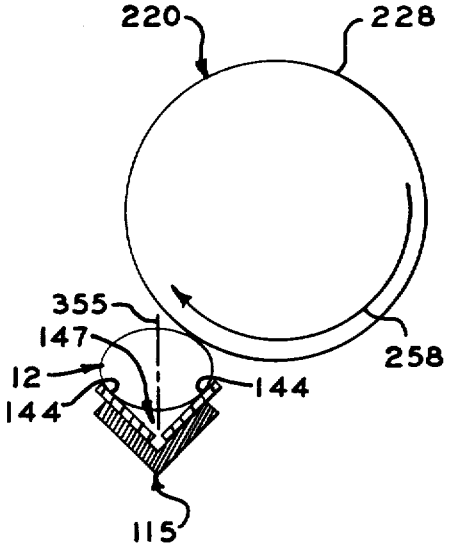
FIG. 9*d* is a vertical section taken from the position of line 9*d*—9*d* in FIG. 9*c* with the oblate article depicted as being engaged by a roller surface.

The apparatus 10 is also adapted, as depicted in FIGS. 9*c* and 9*d*, to assort articles 12, such as onions, which are oblate, being flattened and having a shorter dimension along an axis 355 and a longer dimension normal to this axis. For assorting oblate articles, the drive units 65 are adjusted so that the upper runs 144 of each conveyor move at different relative speeds along the path 111. For example, as indicated by the unequal vectors 357 in FIG. 9*c*, the drive units are adjusted so that the speed of the first belt 141 is somewhat less than the speed of the second belt 142. As a result, the oblate articles are urged to rotate, as indicated by the arrow 358, by frictional engagement with the belts. It will be apparent that such rotation will tumble an oblate article until it is oriented with its shorter axis erect as best shown in FIG. 9*d*. The relative speeds of the belts are adjusted so that a sufficient rotational speed is imparted to each article to achieve this orientation prior to its arrival at the first of the assorting stations 28. The article is thus presented to the assorting stations for assorting by size substantially according to the length of its shorter dimension.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. In an apparatus for assorting articles according to size having means for conveying such articles along a predetermined path from a receiving station through a plurality of successive assorting stations, and means at the assorting stations for removing articles from the conveyor of predetermined respective sizes decreasing in the direction of article conveyance; the conveying means comprising:

A. a pair of transversely substantially planar elongated endless belts;

B. means mounting the belts with substantially horizontal edgewardly adjacent upper runs transversely angularly related to form an upwardly disposed article transporting trough therebetween; and C. drive means for causing the upper runs of the belts to travel longitudinally to transport the articles from the receiving station to the assorting stations.

2. The apparatus of claim 1 in which the drive means drives the belts at different speeds to rotate the articles as they are transported by the conveying means.

3. The apparatus of claim 1 in which the drive means for the belts are independently controlled to regulate the relative speeds of the upper runs of the belts to control the speeds of rotation of the articles transported by the conveying means.

4. The apparatus of claim 1 in which the removing means comprises:

A. rollers individual to the assorting stations each having an axis and a peripheral surface concentric to the axis;

B. means mounting the rollers at their respective assorting stations with their axes substantially parallel to the conveying means for rotation about their respective axes and having peripheral surfaces in predetermined spaced adjacent relation to the conveying means; and C. means for rotating the rollers with their peripheral surfaces adjacent to the conveying means traveled transversely thereof, successive rollers in the direction of article conveyance being spaced more closely to the conveying means to engage articles of correspondingly smaller size to displace the engaged articles transversely from the conveying means.

5. The apparatus of claim 4 in which the roller mounting means is adjustable to assort articles of different sizes.

6. The apparatus of claim 5 in which the upper runs of the belts are disposed in transversely predetermined angular relation to the horizontal and the roller mounting means comprises:

A. frames individual to the rollers having their respective rollers mounted therein;

B. substantially parallel ramps disposed transversely of the conveying means laterally inclined from the conveying means at substantially the same predetermined angular relation to the horizontal as the upper runs of the belts;

C. ramp followers rested on the ramps and supporting respective frames and rollers thereon; and D. means for adjustably positioning the frames laterally toward and from the conveying means whereby the frames are elevationally adjusted in parallelism to space the rollers from the conveying means to accommodate articles of different sizes.

7. The apparatus of claim 1 including a rigid, transversely V-shaped supporting trough having oppositely laterally inclined sides, the upper runs of the belts being individually slidably supported by the sides of the supporting troughs.

8. An apparatus for assorting articles according to size comprising:

A. means for conveying articles along a predetermined elongated path from a receiving station through a plurality of successive assorting stations;

B. a plurality of rollers individually mounted at the assorting stations for rotation about respective axes substantially parallel to and aligned along the conveying means, the rollers having substantially cylindrical peripheral surfaces concentric to the axes of their rollers and frusto-conical ends disposed toward the receiving station, the peripheral surfaces disposed toward the conveyor being progressively more closely spaced from the conveyor in successive increments at the assorting stations; and C. means for rotating the rollers to cause their peripheral surface disposed toward the conveyor to travel transversely of the conveyor to displace articles engaged thereby from the conveyor at their respective assorting stations.

9. An apparatus for assorting articles to size comprising:

A. means for conveying articles along a predetermined elongated path from a receiving station through a plurality of successive assorting stations;

B. a plurality of rollers individually mounted at the assorting stations for rotation about respective axes substantially parallel to the conveying means, the rollers having peripheral surfaces of revolution concentric to the axes of their rollers, the peripheral surfaces disposed toward the conveyor being progressively more closely spaced from the conveyor in successive increments at the assorting stations; and C. means for rotating the rollers to cause their peripheral surfaces disposed toward the conveyor to travel transversely of the conveyor to displace articles engaged thereby from the conveyor at their respective assorting stations; wherein the means for conveying articles comprises:

(1) a pair of endless belts having respective upper runs, the upper runs being substantially parallel in a direction along the path and elongated therealong and being disposed in transversely upwardly divergent adjacent relation; and (2) power drive means for motivating the upper runs in a direction from the receiving station to the assorting stations.

10. The apparatus of claim 9 wherein the conveyor means further comprises a rigid trough extended along the path and having a pair of transversely angularly related sides individually disposed beneath the upper runs, each upper run upwardly engaging the corresponding side of the trough for support thereby.

11. The apparatus of claim 10 wherein the belts are flexible; wherein one side of the rigid trough has an upper edge over which the articles are displaced by the rollers; and wherein the run corresponding to the one side extends upwardly beyond the upper edge and is flexed over the edge by engagement with each article as the article is displaced over the edge so as to protect the article against injury by contact with the edge as the article is displaced thereover.

12. The apparatus of claim 9 wherein articles being conveyed by the conveying means are rested on and between the runs and include articles having a longer dimension and a shorter dimension and wherein the power drive means is controllable A. to drive the belts at substantially the same speed to transport articles along the path substantially without rotational movement relative to the runs, and B. to vary the relative speed of the runs in said direction to impart a rotational movement to the articles relative to the runs so that the shorter dimension of an article having a longer dimension and a shorter dimension assumes a predetermined orientation relative to the runs prior to engagement of the articles by the rollers.

13. The apparatus of claim 9 further comprising means mounting each roller for individual movement adjustably to vary the spacing of the peripheral surface of the roller from the conveying means and selectively to vary the size of articles engaged by the peripheral surface at the corresponding assorting station, thereby determining the size of articles displaced from the conveying means at said station.

14. The apparatus of claim 13 wherein

A. the means for conveying articles comprises a pair of endless belts having individual upper runs, the upper runs being substantially parallel in a direction along the path and elongated therealong and being disposed in transversely upwardly divergent adjacent relation, and B. the roller mounting means comprises a guide constraining the axis of each roller to move at the corresponding assorting station toward and from one of the upper runs in a path generally parallel to the other of the upper runs.

15. The apparatus of claim 14 wherein each roller rotates in a direction such that the peripheral surface thereof disposed toward the runs moves in a direction from said other run toward said one run.

16. The apparatus of claim 14 wherein:

A. said guide is a ramp extending transversely of the runs and conforming to said path of the axis of the roller, and B. the roller mounting means further comprises a follower rested on the ramp for movement therealong and a subframe which is mounted on the follower for movement therewith and which rotationally mounts the roller so that, as the subframe moves transversely of the runs, the follower is urged to move along the ramp guiding the subframe transversely and elevationally in relation to the run in a path corresponding to said path of the roller axis and the roller is carried with the subframe with said axis traversing said path thereof.

17. The apparatus of claim 16 wherein each roller has an axial end portion disposed toward the receiving station and an opposite axial end portion, the periphery of the opposite end portion being cylindrical; the periphery of the one end portion being frusto-conical; the axes of said peripheries being coaxially related; and the periphery of the opposite end portion having a larger diameter end substantially equal in diameter to the diameter of said opposite end portion and a smaller diameter end spaced therefrom toward the receiving station.

18. The apparatus of claim 17 wherein the peripheral portion of the roller is resilient.

19. An apparatus for assorting articles according to size comprising:

A. means for conveying articles along a predetermined elongated path from a receiving station through an assorting station;

B. means at the assorting station for removing articles in a predetermined range of sizes from the conveying means, the removing means having a surface disposed toward the conveying means in a predetermined spaced relation thereto and mounted for movement in a direction transversely of the path, the surface having a portion disposed toward the receiving station and a portion disposed oppositely thereof, said opposite portion being more closely spaced from the conveying means than said portion toward the receiving station and the difference in said spacing of said portions corresponding to the difference between the size of the largest articles in said range and the size of the smallest articles in said range; and C. means for motivating the surface in said direction so that articles in said range are engaged by the surface and displaced transversely from the conveying means at the station; wherein the means for conveying articles comprises a pair of endless belts having respective upper runs, the upper runs being substantially parallel in a direction along the path and elongated therealong and being disposed in transversely upwardly divergent relation; and power drive means for motivating the upper runs in a direction from the receiving station to the assorting stations.

20. An apparatus for assorting articles according to size comprising:

A. a conveyor having a pair of endless belts providing elongated, substantially planar upper runs which, longitudinally, are extended in parallel relation and, transversely, are disposed in edgewardly adjacent, transversely upwardly divergent relation;

B. means for motivating the belts so that the upper runs move in the same direction longitudinally to transport articles rested on and between the runs in said direction;

C. a roller having a peripheral surface which is a surface of revolution about an axis;

D. means mounting the roller for rotation about the axis with the axis extended substantially parallel to said direction and for continuously adjustable movement transversely of the runs along a path generally parallel to one of said runs and toward and from the other of said runs, with the peripheral surface of the roller being disposed in adjacent spaced relation to the runs and the axis remaining in substantial parallelism to said direction as the roller moves along said path; and E. means for rotationally driving the roller about said axis so that the peripheral surface engages those of the transported articles which extend from said other run toward said axis a distance greater than the distance between the peripheral surface and the other run and displaces the articles so extending transversely from the runs, said displaced articles which extend a relatively lesser such distance being displaced only when the axis is moved toward the other run and only those articles which extend a relatively greater such distance being displaced when the axis is moved from said other run, so that the apparatus is adjustable to assort from the conveyor articles larger than a predetermined size in a continuous range of sizes.

21. The apparatus of claim 20 wherein the roller is one of a plurality of such rollers spaced along the belts and the mounting means and the driving means are each one of a plurality of such means individually corresponding to the rollers and wherein, in said direction of movement of the belt, the peripheral surfaces of the rollers are spaced progressively more closely to said other of the runs so that progressively smaller articles are assorted from the runs as the articles are transported thereby.

22. The apparatus of claim 20 wherein said mounting means comprises:

A. a pair of substantially planar ramps spaced transversely of the runs, the ramps extending transversely of the runs and being disposed substantially parallel to said one run;

B. a pair of ramp followers individually rested on the ramps for guided movement therealong;

C. a frame extending across the runs and mounted on the followers for movement therewith transversely of the runs;

D. a bearing mounted on the frame, the bearing rotationally mounting the roller for rotation about the axis thereof; and E. means for adjustably positioning the frame transversely in relation to the runs so that, as the frame is moved transversely thereof, the frame is guided by the ramps elevationally and transversely in relation to the runs and in parallelism with the path of the roller so as to carry the roller along the path thereof.

23. The apparatus of claim 22 wherein the conveyor is one of a plurality of substantially identical conveyors disposed in parallel, transversely side-by-side relation at substantially the same elevation and the roller is one of a plurality of substantially identical rollers individually corresponding to the pairs of runs of the conveyors and substantially aligned transversely thereof, and wherein there is a single said frame mounting each roller of said plurality in substantially identical disposition in relation to the pair of runs of the corresponding conveyor so that, as the frame is so guided by the ramps, the peripheral surface of each roller assumes a substantially identical disposition in relation to the corresponding pair of runs, whereby articles having substantially the same size are assorted from each conveyor by the corresponding roller.

* * * * *